US007121868B2

(12) United States Patent
Peterson

(10) Patent No.: US 7,121,868 B2
(45) Date of Patent: Oct. 17, 2006

(54) ELECTRICAL SPLICE CONNECTOR

(75) Inventor: Jennifer M. Peterson, Epping, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/026,898

(22) Filed: Dec. 30, 2004

(65) Prior Publication Data

US 2006/0148333 A1 Jul. 6, 2006

(51) Int. Cl.
*H01R 13/62* (2006.01)

(52) U.S. Cl. ..... 439/371

(58) Field of Classification Search ..... 439/783–786, 439/791, 371, 390, 391
See application file for complete search history.

(56) References Cited

U.S. PATENT DOCUMENTS

| | | | | |
|---|---|---|---|---|
| 20,074 | A * | 4/1858 | Stahl | 111/71 |
| 399,465 | A | 3/1889 | Bainbridge | |
| 3,290,746 | A | 12/1966 | Broske | 24/126 |
| 3,588,791 | A | 6/1971 | Polidori | 339/247 |
| 4,451,104 | A | 5/1984 | Hodgson et al. | 339/99 R |
| 4,508,409 | A | 4/1985 | Cherry et al. | 339/97 R |
| 4,629,274 | A | 12/1986 | Pollock | 339/95 R |
| 4,634,205 | A | 1/1987 | Gemra | 339/97 P |
| 4,722,189 | A | 2/1988 | Center | 60/635 |
| 4,857,020 | A | 8/1989 | Crosby | 439/783 |
| 5,006,081 | A * | 4/1991 | Counsel et al. | 439/783 |
| 5,624,286 | A * | 4/1997 | Marco | 439/786 |
| 5,683,273 | A | 11/1997 | Garver et al. | 439/784 |
| 5,862,589 | A | 1/1999 | Chadbourne et al. | 29/882 |
| 5,868,588 | A | 2/1999 | Chadbourne et al. | 439/783 |
| 5,916,001 | A | 6/1999 | Chadbourne | 439/783 |
| 5,944,564 | A | 8/1999 | Chadbourne et al. | 439/783 |
| 5,944,565 | A | 8/1999 | Chadbourne et al. | 439/783 |
| 6,152,786 | A * | 11/2000 | Perrin et al. | 439/783 |
| 6,193,565 | B1 | 2/2001 | Herron | 439/783 |
| 6,599,054 | B1 | 7/2003 | Ouimet | 403/374.1 |
| 2002/0142674 | A1 | 10/2002 | Chadbourne et al. | 439/783 |

FOREIGN PATENT DOCUMENTS

| | | | |
|---|---|---|---|
| DE | 0017049 | * 10/1980 | 439/783 |

OTHER PUBLICATIONS

Product Brochure, Burndy Products MC-00 The WEJTAP™ System, 6 pages.

* cited by examiner

*Primary Examiner*—Phuong Dinh
(74) *Attorney, Agent, or Firm*—Harrington & Smith, LLP

(57) ABSTRACT

An electrical splice connector including a shell and two wedges. The shell includes two wedge receiving areas. The receiving areas are located at least partially lateral to each other. Each receiving area includes a general wedge shape. Each receiving area also includes a conductor contact surface generally parallel with each other. The two wedges are adapted to be inserted into the receiving areas to wedge electrical conductors against the conductor contact surface.

20 Claims, 6 Drawing Sheets

ELECTRICAL SPLICE CONNECTOR

BACKGROUND OF THE INVENTION

1. Field of the Invention

The present invention relates to an electrical connector and, more particularly, to a splice for connecting multiple electrical connectors to one another.

2. Brief Description of Prior Developments

U.S. Pat. No. 6,193,565 discloses a splicing connector having a connector shell with a double C shaped tapering cross section. The splicing connector includes two wedge assemblies that are inserted into the C shaped connector shell for attaching two electrical conductors to each other. Electrical wedge connectors are also well known in the art, such as disclosed in U.S. Pat. No. 5,868,588 which include a tapering cross sectional C shape shell and a wedge. A power actuated tool, such as a WEJTAP™ tool sold by FCI USA, Inc., is used to propel the wedge into the shell to fixedly attach to conductors to each other.

In the early 1990's, an automatic splice was introduced to the electric utility market in the United States. Although initially promoted as a convenient, temporary connection to speed outage restoration, its easy, tool-free installation quickly made it a favorite among linemen. In rather short order, automatic splices were soon being employed as permanent installations in almost every utility in the United States. However, 10 years later, automatic splices are failing at an alarming rate and most major utilities are desperately seeking a reliable, cost-efficient replacement. However, despite these failures, most utilities remain unwilling to mandate a return to the time tested (but labor-intensive) process of installing compression high-tension sleeves. As such, an incredibly large and enormously profitable, untapped market awaits the first manufacturer to produce a high-tension splice that provides reliability and ease of installation at an affordable price.

SUMMARY OF THE INVENTION

In accordance with one aspect of the present invention, an electrical splice connector is provided including a shell and two wedges. The shell includes two wedge receiving areas. The receiving areas are located at least partially lateral to each other. Each receiving area includes a general wedge shape. Each receiving area also includes a conductor contact surface generally parallel with each other. The two wedges are adapted to be inserted into the receiving areas to wedge electrical conductors against the conductor contact surfaces.

In accordance with another aspect of the present invention, an electrical splice connector shell is provided comprising a first wedge receiving section; and a second wedge receiving section connected to the first wedge receiving section. The first and second wedge receiving sections each comprise a wedge receiving area having a center plane along their lengths which are generally parallel and lateral to each other. The wedge receiving areas are at least partially lateral relative to each other.

In accordance with one method of the present invention, a method of manufacturing an electrical splice connector shell is provided comprising forming a first wedge receiving section having a first wedge receiving area; and forming a second wedge receiving section having a second wedge receiving area. The first and second wedge receiving areas each comprise a conductor contact surface which are generally parallel to each other forming two at least partially laterally aligned conductor receiving areas.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
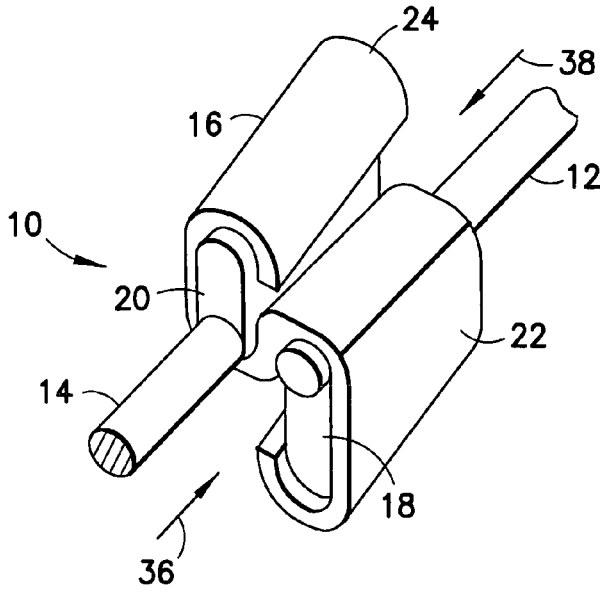
FIG. 1 is a perspective view of an electrical splice connector incorporating features of the present invention shown attached to ends of two electrical conductors.

Referring to FIG. 1, there is shown a perspective view of an electrical splice connector 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

Figure 2:
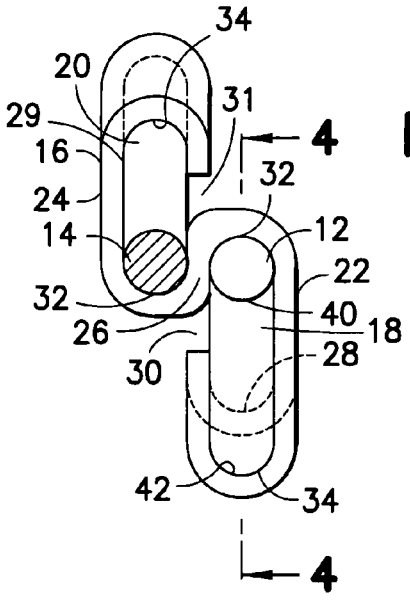
FIG. 2 is an end view of the electrical splice connector and conductor assembly shown in FIG. 1.
Figure 3:
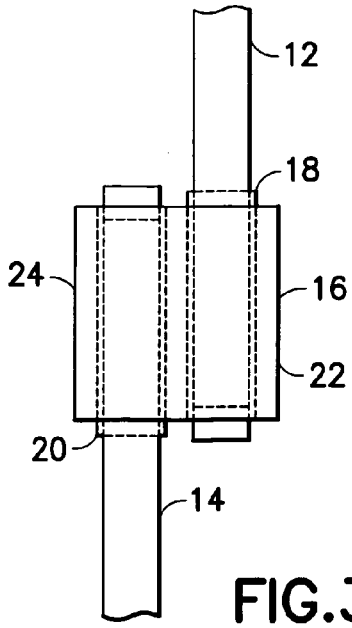
FIG. 3 is a top plan view of the electrical splice connector and conductor assembly shown in FIG. 1.
Figure 4:
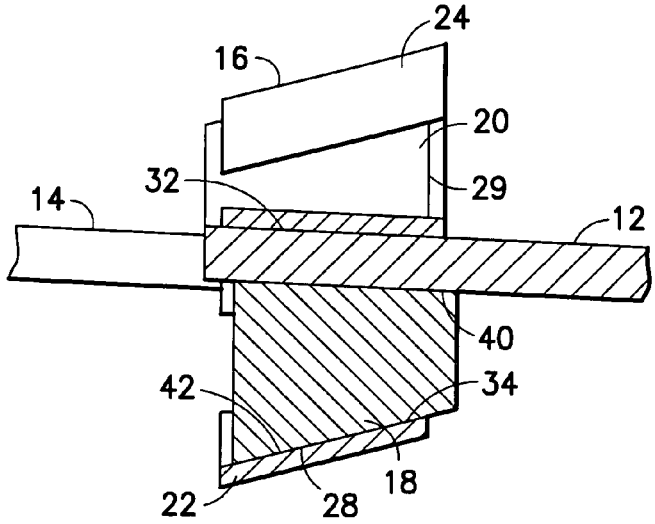
FIG. 4 is a cross sectional view of the electrical splice connector and conductor assembly shown in FIG. 2 taken along line 4—4.
Figure 5:
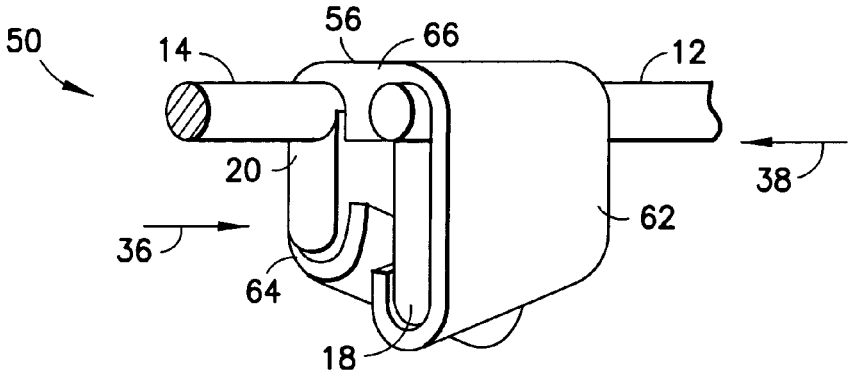
FIG. 5 is a perspective view of an alternate embodiment of the electrical splice connector shown attached to ends of the two electrical conductors.
Figure 6:
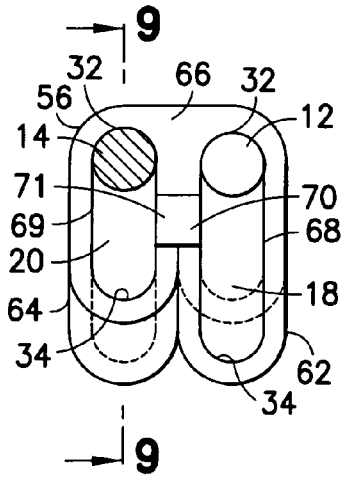
FIG. 6 is an end view of the electrical splice connector and conductor assembly shown in FIG. 5.
Figure 7:
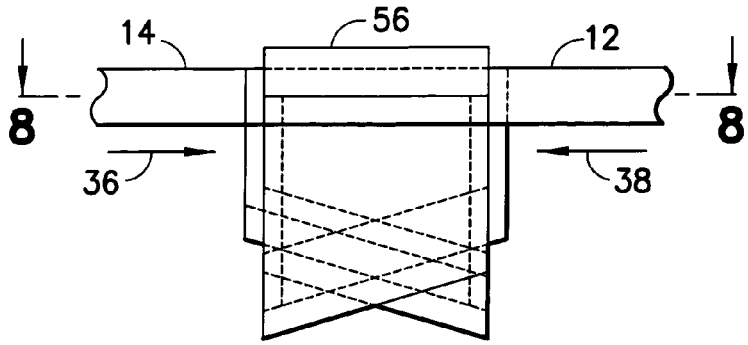
FIG. 7 is a side view of the electrical splice connector and conductor assembly shown in FIG. 1.
Figure 8:
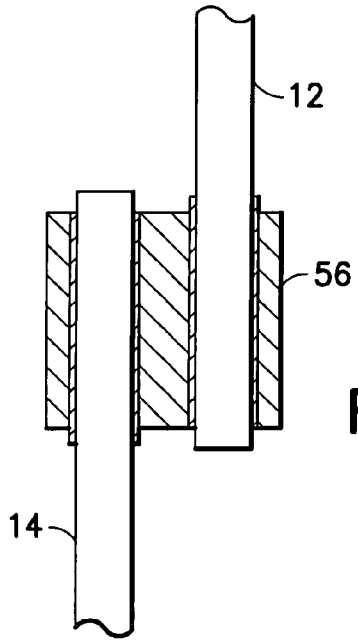
FIG. 8 is a cross sectional view of the electrical splice connector and conductor assembly shown in FIG. 7 taken along line 8—8.
Figure 9:
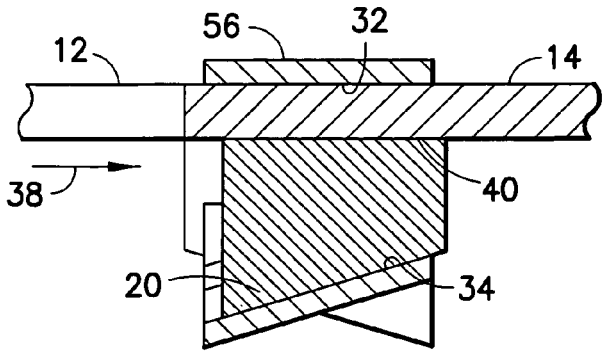
FIG. 9 is a cross sectional view of the electrical splice connector and conductor assembly shown in FIG. 6 taken along line 9—9.
Figure 10:
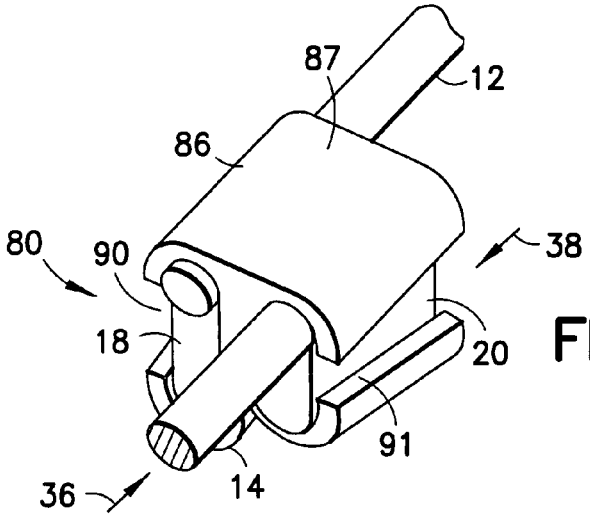
FIG. 10 is a perspective view of an alternate embodiment of the electrical splice connector shown attached to ends of the two electrical conductors.
Figure 11:
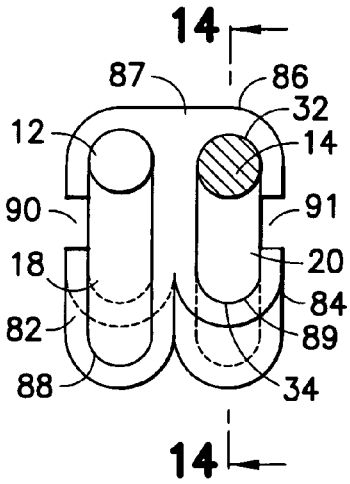
FIG. 11 is an end view of the electrical splice connector and conductor assembly shown in FIG. 10.
Figure 12:
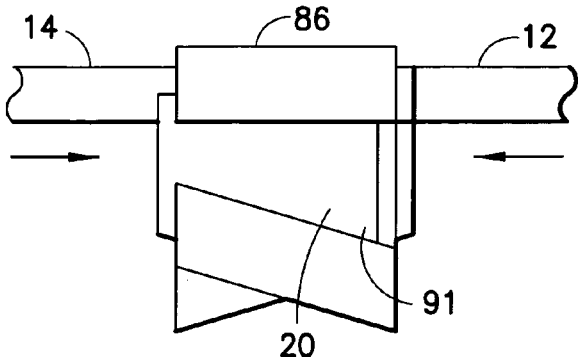
FIG. 12 is a side view of the electrical splice connector and conductor assembly shown in FIG. 10.
Figure 13:
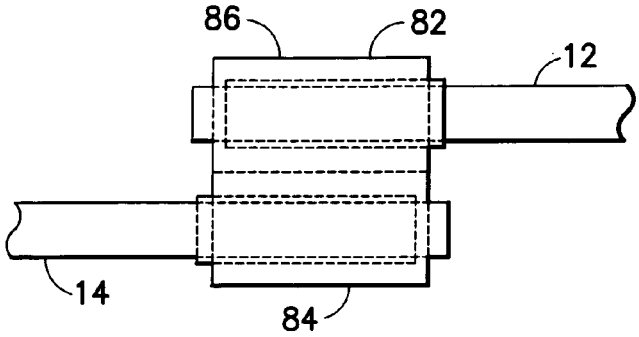
FIG. 13 is top plan view of the electrical splice connector and conductor assembly shown in FIG. 10.
Figure 14:
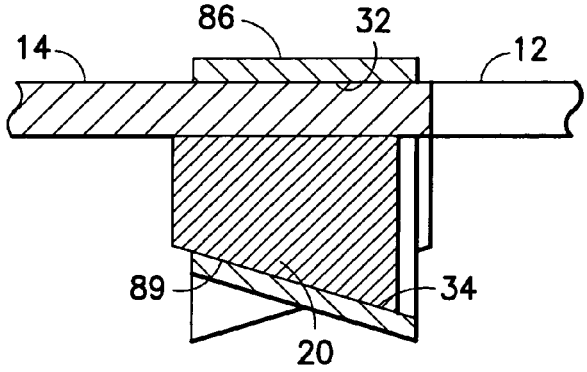
FIG. 14 is a cross sectional view of the electrical splice connector and conductor assembly shown in FIG. 11 taken along line 14—14.
Figure 15:
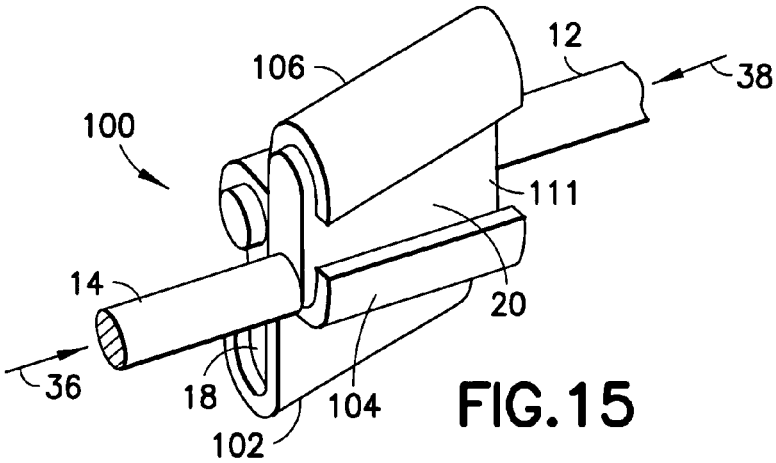
FIG. 15 is a perspective view of an alternate embodiment of the electrical splice connector shown attached to ends of the two electrical conductors.
Figure 16:
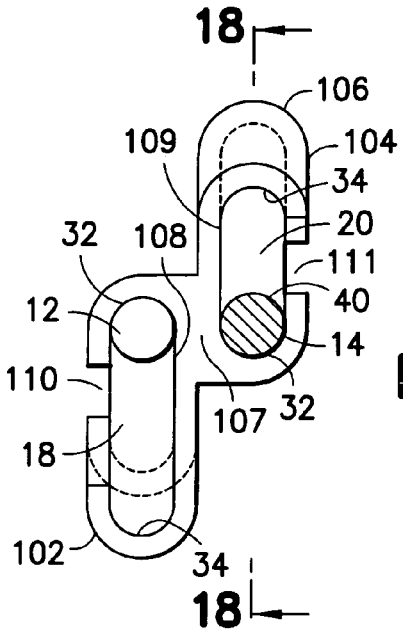
FIG. 16 is an end view of the electrical splice connector and conductor assembly shown in FIG. 15.
Figure 17:
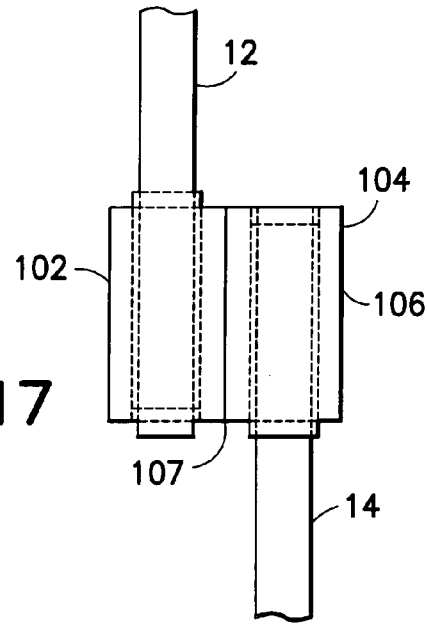
FIG. 17 is top plan view of the electrical splice connector and conductor assembly shown in FIG. 15.
Figure 18:
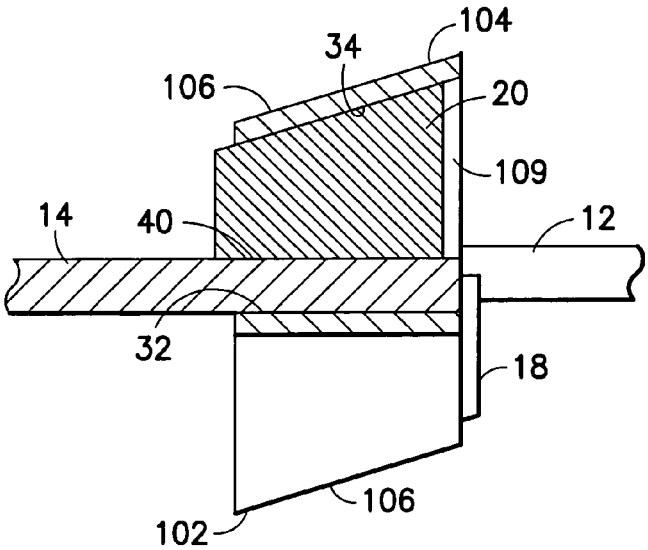
FIG. 18 is a cross sectional view of the electrical splice connector and conductor assembly shown in FIG. 16 taken along line 18—18.

The electrical splice connector 10 is shown mechanically and electrically connecting two electrical conductors 12, 14 to each other. Referring also to FIGS. 2–4, the splice connector 10 generally comprises a shell 16 and two wedges 18, 20. In an alternate embodiment additional components could be provided, such as an external insulative cover for example. The shell 16 comprises a one-piece member made of electrically conductive material. For example, the shell 16 could be comprised of stamped and folded metal, cast metal or extruded and formed metal. In an alternate embodiment, the shell 16 could be comprised of multiple members, such as multiple members which are stationarily attached to each other for example. The shell 16 generally comprises two wedge receiving sections 22, 24. The wedge receiving sections 22, 24 are connected to each other by a bridging section 26.

In the embodiment shown, each wedge receiving section 22, 24 comprises a wedge receiving area 28, 29. The wedge receiving sections 22, 24 comprise a general C shaped cross-section. The C shapes form the wedge receiving areas 28, 29 with openings 30, 31 through lateral side walls of the wedge receiving sections into each respective wedge receiving areas. However, in alternate embodiments a shape other than a C shape could be provided. The wedge receiving areas 28, 29 comprise a general wedge shape. The first wedge receiving area 28 tapers in a reverse direction relative to the taper of the second wedge receiving area 29. The wedge receiving areas 28, 29 have a center plane along their lengths which are generally parallel to each other. The two wedge receiving sections 22, 24 are located lateral to each other and, thus, the central planes of the wedge receiving areas are also located lateral to each other. Each wedge shape receiving area 28, 29 comprises a conductor contact surface 32 and an opposing wedge contact surface 34. In this embodiment, the contact surfaces 32, 34 are located at opposing top and bottom sides of each wedge receiving area. As seen best in FIG. 2, The shell 16 and wedges 18, 24 are located in the conductor receiving areas which are laterally offset relative to each other, but are at least partially lateral to each other and adjacent to each other in a horizontal plane when the wedges 18, 20 are vertically orientated. The bridging section 26 is located in the middle of the shell and connects the top of one of the C shaped sections to the bottom of the other C shaped section.

The wedges 18, 20, in the embodiment shown, are substantially identical to each other. However, the wedges are inserted into the shell 16 in reverse directions as indicated by arrows 36 and 38, respectively, and flipped relative to each other to locate the conductor contact surfaces 40 of the wedges against the electrical conductors 12, 14. Each wedge 18, 20 has a general wedge shaped profile with a conductor contact surface 40 on one side and a shell contact surface 42 on the opposite side. The conductor contact surface 40 comprises a general groove shape. The shell contact surface 42 comprises a general convex shape.

To attach the splice 10 to the conductors 12, 14, the first conductor 12 is inserted into the first wedge receiving section 22 adjacent the conductor contact surface 32 in the first section and the first wedge 18 is inserted into the first wedge receiving section 22 as indicated by arrow 36. The first wedge 18 is preferably power wedged into the first section 22 by a suitable tool, such as the tool shown in U.S. Pat. No. 4,722,189 which is hereby incorporated by reference in its entirety. However, in alternate embodiments, any suitable tool could be used to wedge the first wedge 18 into the shell 16. When the first wedge 18 is wedged into the shell 16 by the tool, the first conductor 12 is fixedly captured between the two conductor contact surfaces 32, 40 in the first wedge receiving section 22.

The second conductor 14 is inserted into the second wedge receiving section 24 adjacent the conductor contact surface 32 in the second section and the second wedge 20 is inserted into the second section 24 as indicated by arrow 38. The second wedge 20 is preferably power wedged into the second section 24 by a suitable tool, such as the tool(s) mentioned above. When the second wedge 20 is wedged into the shell 16 by the tool, the second conductor 14 is fixedly captured between the two conductor contact surfaces 32, 40 in the second section 24. The direction 36 of insertion of the first wedge 18 is reverse to the direction 38 of insertion of the wedge 20. In this embodiment, the two directions 36, 38 are generally parallel and laterally adjacent towards each other. However, in an alternate embodiment, the two directions could be away from each other or angled relative to each other. The two conductors 12, 14 are, thus, fixedly connected by the splice 10 in a general aligned laterally adjacent position. The splice 10 provides both a mechanical and an electrical connection between the two conductors 12, 14.

Referring now to FIGS. 5–9, one alternate embodiment of the present invention is shown. In this embodiment the splice connector 50 generally comprises a shell 56 and two wedges 18, 20. The shell 56 comprises a one-piece member made of electrically conductive material. For example, the shell 56 could be comprised of stamped and folded metal, cast metal or extruded and formed metal. In an alternate embodiment, the shell 56 could be comprised of multiple members, such as multiple members which are stationarily attached to each other for example. The shell 56 generally comprises two wedge receiving sections 62, 64. The wedge receiving sections 62, 64 are connected to each other by a bridging section 66.

In the embodiment shown, each wedge receiving section 62, 64 comprises a wedge receiving area 68, 69. The wedge receiving sections 62, 64 each comprise a general C shaped cross-section which form the wedge receiving areas 68, 69 with respective openings 70, 71 through lateral side walls of the wedge receiving sections into the wedge receiving areas. The wedge receiving areas 68, 69 comprise a general wedge shape. The first wedge receiving area 68 tapers in a reverse direction relative to the taper of the second wedge receiving area 69. The wedge receiving areas 68, 69 have a center plane along their lengths which are generally parallel and lateral to each other. The two wedge receiving sections 62, 64 are located lateral to each other and, thus, the central planes of the wedge receiving areas are also located lateral to each other. The bridging section 66 connects the tops of the two C shaped sections to each other such that the C shape sections face each other. Thus, the tops of the C shaped sections share a common top side of the shell. The openings 70, 71 face each other.

Each wedge shape receiving area 68, 69 comprises a conductor contact surface 32 and an opposing wedge contact surface 34. In this embodiment, the contact surfaces 32, 34 are located at opposing top and bottom sides of each wedge receiving area. As seen best in FIG. 6, the shell 56 and wedges 18, 20 form conductor receiving areas which are laterally offset relative to each other, but are at least partially lateral to each other and adjacent to each other in a horizontal plane when the wedges 18, 20 are generally vertically orientated.

To attach the splice 50 to the conductors 12, 14, the first conductor 12 is inserted into the first wedge receiving section 62 adjacent the conductor contact surface 32 in the first section and the first wedge 18 is inserted into the first wedge receiving section 62 as indicated by arrow 36. The first wedge 18 is preferably power wedged into the first section 62 by a suitable tool, such as the tool shown in U.S. Pat. No. 4,722,189. When the first wedge 18 is wedged into the shell 56 by the tool, the first conductor 12 is fixedly captured between the two conductor contact surfaces 32, 40.

The second conductor 14 is inserted into the second wedge receiving section 64 adjacent the conductor contact surface 32 in the second section and the second wedge 20 is inserted into the second section 64 as indicated by arrow 38. The second wedge 20 is preferably power wedged into the second section 64 by a suitable tool, such as the tool(s) mentioned above. When the second wedge 20 is wedged into the shell 56 by the tool, the second conductor 14 is fixedly captured between the two conductor contact surfaces 32, 40. The direction 36 of insertion of the first wedge 18 is reverse to the direction 38 of insertion of the wedge 20. In this embodiment, the two directions 36, 38 are generally parallel to each other, but could be angled. The two conductors 12, 14 are, thus, fixedly connected by the splice 50 in a general aligned laterally adjacent position.

Referring now to FIGS. 10–14, another alternate embodiment of the present invention is shown. In this embodiment the splice connector 80 generally comprises a shell 86 and two wedges 18, 20. The shell 86 comprises a one-piece member made of electrically conductive material. The shell 86 generally comprises two wedge receiving sections 82, 84. The wedge receiving sections 82, 84 are connected to each other by a bridging section 87.

In the embodiment shown, each wedge receiving section 82, 84 comprises a wedge receiving area 88, 89. The wedge receiving sections 82, 84 each comprise a general C shaped cross-section which form the wedge receiving areas 88, 89 with openings 90, 91 through lateral side walls of the wedge receiving sections into the wedge receiving areas. The wedge receiving areas 88, 89 comprise a general wedge shape. The first wedge receiving area 88 tapers in a reverse direction relative to the taper of the second wedge receiving area 89. The wedge receiving areas 88, 89 have a center plane along their lengths which are generally parallel to each other, but could be angled. The two wedge receiving sections 82, 84 are located lateral to each other and, thus, the central planes of the wedge receiving areas are also located lateral to each other. The bridging section 87 connects the tops and middles of the two C shaped sections to each other. Thus, the tops of the C shaped sections share a common top side of the shell. The openings 90, 91 are located at opposite lateral sides of the shell and face outward in opposite directions.

Each wedge shape receiving area 88, 89 comprises a conductor contact surface 32 and an opposing wedge contact surface 34. In this embodiment, the contact surfaces 32, 34 are located at opposing top and bottom sides of each wedge receiving area. As seen best in FIG. 11, the shell 86 and wedges 18, 20 form conductor receiving areas which are laterally offset relative to each other, but are at least partially lateral to each other and aligned adjacent to each other in a horizontal plane when the wedges 18, 20 are vertically orientated.

To attach the splice 80 to the conductors 12, 14, the first conductor 12 is inserted into the first wedge receiving section 82 adjacent the conductor contact surface 32 in the first section and the first wedge 18 is inserted into the first wedge receiving section 82 as indicated by arrow 36. The first wedge 18 is preferably power wedged into the first section 82 by a suitable tool, such as mentioned above. When the first wedge 18 is wedged into the shell 86 by the tool, the first conductor 12 is fixedly captured between the two conductor contact surfaces 32, 40 in the first wedge receiving area.

The second conductor 14 is inserted into the second wedge receiving section 84 adjacent the conductor contact surface 32 in the second section and the second wedge 20 is inserted into the second section 84 as indicated by arrow 38. The second wedge 20 is preferably power wedged into the second section 84 by a suitable tool, such as the tool(s) mentioned above. When the second wedge 20 is wedged into the shell 86 by the tool, the second conductor 14 is fixedly captured between the two conductor contact surfaces 32, 40. The direction 36 of insertion of the first wedge 18 is generally reverse to the direction 38 of insertion of the wedge 20, but could have any suitable angled direction. In this embodiment, the two directions 36, 38 are generally parallel to each other. The two conductors 12, 14 are, thus, fixedly connected by the splice 80 in a general aligned laterally adjacent position.

Referring now to FIGS. 15–19, another alternate embodiment of the present invention is shown. In this embodiment the splice connector 100 generally comprises a shell 106 and two wedges 18, 20. The shell 106 preferably comprises a one-piece member made of electrically conductive material. The shell 106 generally comprises two wedge receiving sections 102, 104. The wedge receiving sections 102, 104 are connected to each other by a bridging section 107.

In the embodiment shown, each wedge receiving section 102, 104 comprises a wedge receiving area 108, 109. The wedge receiving sections 102, 104 comprise a general C shaped cross-section which forms the wedge receiving areas 108, 109 with an opening 110, 111 through a lateral side wall of the wedge receiving sections into the wedge receiving areas. The wedge receiving areas 108, 109 comprise a general wedge shape. The first wedge receiving area 108 tapers in a reverse direction relative to the taper of the second wedge receiving area 109. The wedge receiving areas 108, 109 have a center plane along their lengths which are generally parallel and lateral to each other. The two wedge receiving sections 102, 104 are located lateral to each other and, thus, the central planes of the wedge receiving areas are also located lateral to each other. The bridging section 107 connects the tops and middles of the two C shaped sections to each other. Thus, the tops of the C shaped sections share a common top side of the shell. The openings 110, 111 are located at opposite lateral sides of the shell and face outward in opposite directions.

Each wedge shape receiving area 108, 109 comprises a conductor contact surface 32 and an opposing wedge contact surface 34. In this embodiment, the contact surfaces 32, 34 are located at opposing top and bottom sides of each wedge receiving area. As seen best in FIG. 16, the shell 106 and wedges 18, 20 form conductor receiving areas which are laterally offset relative to each other, but are at least partially lateral to each other and aligned adjacent to each other in a horizontal plane when the wedges 18, 20 are vertically orientated.

To attach the splice 100 to the conductors 12, 14, the first conductor 12 is inserted into the first wedge receiving section 102 adjacent the conductor contact surface 32 in the first section and the first wedge 18 is inserted into the first wedge receiving section 102 as indicated by arrow 36. The first wedge 18 is preferably power wedged into the first section 102 by a suitable tool, such as mentioned above. When the first wedge 18 is wedged into the shell 106 by the tool, the first conductor 12 is fixedly captured between the two conductor contact surfaces 32, 40 in the first wedge receiving area.

The second conductor 14 is inserted into the second wedge receiving section 104 adjacent the conductor contact surface 32 in the second section and the second wedge 20 is inserted into the second section 104 as indicated by arrow 38. The second wedge 20 is preferably power wedged into the second section 104 by a suitable tool, such as the tool(s) mentioned above. When the second wedge 20 is wedged into the shell 106 by the tool, the second conductor 14 is fixedly captured between the two conductor contact surfaces 32, 40. The direction 36 of insertion of the first wedge 18 is reverse to the direction 38 of insertion of the wedge 20. In this embodiment, the two directions 36, 38 are generally parallel and laterally adjacent towards each other. The two conductors 12, 14 are, thus, fixedly connected by the splice 100 in a general aligned laterally adjacent position, but they can be slightly vertically offset.

In an alternate embodiment, the shell could comprise more than two wedge receiving areas and/or more than two wedge receiving sections. The wedge receiving areas or sections cold be angled relative to each other. Their center planes need not be parallel. In the description above, terms of reference, such as "top", "bottom", "horizontal", and "vertical" for example, have been used. However, it should be understood that these terms are merely used for purposes of reference and should not be considered as limiting because the splice connector can easily be re-orientated and still function the same way.

With the present invention the ends of conductors 12, 14 can be located close to each other, parallel to each other, and laterally adjacent to each other. This is particularly advantageous for use of the splice connector in a tension application (i.e., when the conductors 12, 14 are under a tension load). The location of the ends of the conductors next to each other (separated only by a small portion of the shell) helps to minimize torsional forces inside the splice connector and, thus, reduces forces which might act on disassembling the splice connector from such tension forces on each conductor being not in-line with each other. Locating the wedges as shown in FIGS. 4, 9, 14 and 18 such that they are further wedged into the wedge receiving areas by tension of the conductors further helps to reduce the effects of pull-out forces caused by the conductor tension. The C shape of the wedge receiving sections allow for insertion of the conductors through the openings in the lateral sides of the receiving sections. This allows for faster positioning of the components for faster connection of the splice connector to the conductors. The C shape and side openings into the receiving areas also allows each C shape section to deflect slightly when the wedge is power wedged into its receiving section. This can provide for better clamping action of the curved ends of the C shape against the opposite ends of the conductor and wedge pair.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical splice connector comprising:

a shell comprising two wedge receiving areas, wherein the receiving areas are located at least partially lateral to each other, wherein each receiving area comprises a general wedge shape, wherein each receiving area comprises a conductor contact surface, and wherein the receiving areas are generally parallel with each other; and two wedges adapted to be inserted into the receiving areas to wedge electrical conductors against the conductor contact surface, and wherein the wedge receiving areas are at least partially vertically offset from each other.

2. An electrical splice connector as in claim 1 wherein the shell comprises a one-piece member made of electrically conductive material.

3. An electrical splice connector as in claim 2 wherein the shell comprises an extruded metal member.

4. An electrical splice connector comprising:

a shell comprising two wedge receiving areas, wherein the receiving areas are located at least partially lateral to each other, wherein each receiving area comprises a general wedge shape, wherein each receiving area comprises a conductor contact surface, and wherein the receiving areas are generally parallel with each other; wherein each wedge receiving area comprises a general wedge shape, and wherein the wedge shapes are generally reverse in orientation relative to each other with smaller ends of each wedge receiving area at respective different ends of the shell, and two wedges adapted to be inserted into the receiving areas to wedge electrical conductors against the conductor contact surface.

5. An electrical splice connector as in claim 1 wherein each wedge receiving area comprises an opening through a lateral side wall.

6. An electrical splice connector as in claim 5 wherein the openings are respectively located at two lateral outer sides of the shell.

7. An electrical splice connector as in claim 5 wherein the openings are located at least partially adjacent each other.

8. An electrical splice connector as in claim 1 wherein the conductor contact surfaces face a same direction.

9. An electrical splice connector as in claim 1 wherein the conductor contact surfaces face opposite directions.

10. An electrical splice connector as in claim 4 wherein the conductor contact surfaces are substantially laterally aligned with each other.

11. An electrical splice connector as in claim 1 wherein the shell comprises two wedge receiving sections forming the wedge receiving areas, and wherein the wedge receiving sections comprise general C shaped cross sections.

12. An electrical splice connector shell comprising:

a first wedge receiving section; and a second wedge receiving section connected to the first wedge receiving section, wherein the first and second wedge receiving sections each comprise a wedge receiving area having a center plane along their lengths which are generally parallel and lateral to each other, wherein the wedge receiving areas are at least partially lateral relative to each other, wherein each wedge receiving area comprises a general wedge shape, wherein the wedge shapes are generally reverse in orientation relative to each other with smaller ends of the general wedge shaped receiving areas located at respective different ends of the shell, and wherein the wedge receiving areas are at least partially vertically offset from each other.

13. An electrical splice connector shell as in claim 12 wherein the shell comprises a one-piece member made of electrically conductive material.

14. An electrical splice connector shell as in claim 12 wherein the shell comprises an extruded metal member.

15. An electrical splice connector shell comprising:

a first wedge receiving section; and a second wedge receiving section connected to the first wedge receiving section, wherein the first and second wedge receiving sections each comprise a wedge receiving area having a center plane along their lengths which are generally parallel and lateral to each other, wherein the wedge receiving areas are at least partially lateral relative to each other, wherein each wedge receiving area comprises a general wedge shape, wherein the wedge shapes are generally reverse in orientation relative to each other with smaller ends of the general wedge shaped receiving areas located at respective different ends of the shell, and wherein each wedge receiving section comprises an opening through a lateral side wall into its wedge receiving area.

16. An electrical splice connector shell as in claim 15 wherein the openings are respectively located at two lateral outer sides of the shell.

17. An electrical splice connector shell comprising:

a first wedge receiving section; and a second wedge receiving section connected to the first wedge receiving section, wherein the first and second wedge receiving sections each comprise a wedge receiving area having a center plane along their lengths which are generally parallel and lateral to each other, wherein the wedge receiving areas are at least partially lateral relative to each other, wherein each wedge receiving area comprises a general wedge shape, wherein the wedge shapes are generally reverse in orientation relative to each other with smaller ends of the general wedge shaped receiving areas located at respective different ends of the shell, and wherein each wedge receiving section comprises a conductor contact surface in its wedge receiving area, and wherein the conductor contact surfaces face a same direction.

18. An electrical splice connector shell comprising:

a first wedge receiving section; and a second wedge receiving section connected to the first wedge receiving section, wherein the first and second wedge receiving sections each comprise a wedge receiving area having a center plane along their lengths which are generally parallel and lateral to each other, wherein the wedge receiving areas are at least partially lateral relative to each other, wherein each wedge receiving area comprises a general wedge shape, wherein the wedge shapes are generally reverse in orientation relative to each other with smaller ends of the general wedge shaped receiving areas located at respective different ends of the shell, and wherein each wedge receiving section comprises a conductor contact surfaces face, and wherein the conductor contact surfaces face opposite directions.

19. An electrical splice connector shell comprising:

a first wedge receiving section; and a second wedge receiving section connected to the first wedge receiving section, wherein the first and second wedge receiving sections each comprise a wedge receiving area having a center plane along their lengths which are generally parallel and lateral to each other, wherein the wedge receiving areas are at least partially lateral relative to each other, wherein each wedge receiving area comprises a general wedge shape, wherein the wedge shapes are generally reverse in orientation relative to each other with smaller ends of the general wedge shaped receiving areas located at respective different ends of the shell, and wherein each wedge receiving section comprises a conductor contact surfaces face, and wherein the conductor contact surfaces are substantially laterally aligned with each other.

20. A method of connecting two electrical conductors to each other comprising:

manufacturing an electrical splice connector shell comprising:

forming a first wedge receiving section having a first wedge receiving area; and forming a second wedge receiving section having a second wedge receiving area, wherein the first and second wedge receiving areas each comprise a conductor contact surface which are generally parallel to each other forming two at least partially laterally aligned conductor receiving areas, wherein the first wedge receiving area has a small end located at a different end of the shell than a small end of the second wedge receiving area;

inserting a first one of the electrical conductors into the first wedge receiving area;

inserting a first wedge into the first wedge receiving area to wedge the first electrical conductor against the conductor contact surface in the first wedge receiving area;

inserting a second one of the electrical conductors into the second wedge receiving area; and inserting a second wedge into the second wedge receiving area to wedge the second electrical conductor against the conductor contact surface in the second wedge receiving area, wherein the second wedge is wedged into the shell in a general reverse direction to insertion of the first wedge into the shell.

* * * * *